US009302512B1

(12) United States Patent
Matsuura

(10) Patent No.: US 9,302,512 B1
(45) Date of Patent: Apr. 5, 2016

(54) INK-JET PRINTER

(71) Applicant: Brother Kogyo Kabushiki Kaisha, Nagoya-shi, Aichi-ken (JP)

(72) Inventor: Kazunari Matsuura, Komaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/832,035

(22) Filed: Aug. 21, 2015

(30) Foreign Application Priority Data

Sep. 26, 2014 (JP) ..... 2014-197314

(51) Int. Cl.
*B41J 2/15* (2006.01)
*B41J 13/00* (2006.01)

(52) U.S. Cl.
CPC ..... *B41J 13/0009* (2013.01)

(58) Field of Classification Search
USPC ..... 347/41, 16, 19
See application file for complete search history.

(56) References Cited

U.S. PATENT DOCUMENTS 6,644,783 B1 * 11/2003 Tsuruoka ..... B41J 2/04541 347/40
7,050,193 B1 * 5/2006 Downing ..... B41J 11/46 358/1.1
7,370,927 B2 * 5/2008 Kuruma ..... B41J 29/38 347/12
2009/0046119 A1 2/2009 Edamura et al.

FOREIGN PATENT DOCUMENTS

| | | |
|---|---|---|
| JP | H07-117241 | 5/1995 |
| JP | 2001-322262 | 11/2001 |
| JP | 2004-025627 | 1/2004 |
| JP | 2004-042432 | 2/2004 |
| JP | 2009-061774 | 3/2009 |

* cited by examiner

*Primary Examiner* — Lamson Nguyen
(74) *Attorney, Agent, or Firm* — Frommer Lawrence & Haug LLP

(57) ABSTRACT

There is provided an inkjet printer including an inkjet head, a conveyance section, and a controller. The ink jet head includes a plurality of nozzle groups. Between the plurality of nozzle groups, the nozzles forming the nozzle groups are positioned in conformity with each other, respectively, in a second direction. The controller causes the conveyance section to convey the recording medium between a first pass and a second pass such that the respective nozzle groups have partly overlapped scanning areas, and causes the ink jet head to print separately between the first pass and the second pass in the second direction. The controller sets usable bordering positions in the overlapping range with respect to the passes. The controller sets the usable bordering positions based on one of such conditions as a duty of printing on the recording medium and a type of the nozzle groups to be used in printing.

10 Claims, 11 Drawing Sheets

Fig. 9

| INK COLOR USED | TOTAL DUTY Da | USABLE BORDERING POSITION |
|---|---|---|
| KYCM | High | K |
| | | Y |
| | | C |
| | | M |
| YCM | High | Y |
| | | C |
| | | M |
| KYC | High | K |
| | | Y |
| | | C |
| KCM | High | K |
| | | C |
| | | M |
| KY | High | K |
| | | Y |
| ⋮ | ⋮ | ⋮ |
| KYCM | Low | K |
| | | YCM |
| YCM | Low | YCM |
| KCM | Low | K |
| | | CM |
| ⋮ | ⋮ | ⋮ |

Fig. 10

| INK COLOR USED | TOTAL DUTY Da | USABLE BORDERING POSITION |
|---|---|---|
| KYCM | High | K |
| | | Y |
| | | C |
| | | M |
| YCM | High | Y |
| | | C |
| | | M |
| KYC | High | K |
| | | Y |
| | | C |
| KCM | High | K |
| | | C |
| | | M |
| KY | High | K |
| | | Y |
| ⋮ | ⋮ | ⋮ |
| KYCM | Low | KY |
| | | CM |
| YCM | Low | YCM |
| KCM | Low | K |
| | | CM |
| KYC | Low | K |
| | | YC |
| ⋮ | ⋮ | ⋮ |

INK-JET PRINTER

CROSS REFERENCE TO RELATED APPLICATION

The present application claims priority from Japanese Patent Application No. 2014-197314 filed on Sep. 26, 2014, the disclosure of which is incorporated herein by reference in their entirety.

BACKGROUND

1. Field of the Invention

The present invention relates to ink-jet printers configured to jet ink onto a recording medium to print images.

2. Description of the Related Art

There are ink-jet printers adopting such a method as to jet ink respectively from a plurality of nozzles to print image while moving an ink-jet head having the plurality of nozzles in a predetermined scanning direction relative to a recording medium. Such printer prints the image on the recording medium by alternately carrying out one single movement of the ink jet head in the scanning direction (to be also referred to below as a pass), and a transportation of the recording medium in a transport direction by a predetermined length.

However, due to some factors such as deviation in transported length and the like, the abovementioned printer may cause deviation in the transport direction between the image part printed in a previous pass and the image part printed in the successive pass. Such cases may give rise to non-uniform shading (white streaks and black streaks) in the shape of streaks extending in the scanning direction between the two image parts. Any occurrence of such non-uniform shading greatly lowers the quality of the image printed on the recording medium.

In this regard, there is known such a printer as is capable of suppressing occurrence of the streak shaped non-uniform shading mentioned above. This printer causes the scanning area of a previous pass to overlap partially with the scanning area of the successive pass in the transport direction of the recording medium. On top of that, it zigzag changes the border between the image part printed in the previous pass and the image part printed in the successive pass. Further, in the case of multicolor printing, each such border as mentioned above may be misaligned from another (i.e. differ in alignment with another) between the nozzle rows for different colors. By adopting such a printing method as described above, the streaks become less likely to be conspicuous between the image part printed in the previous pass and the image part printed in the successive pass. However, there is no knowledge about under what kind of conditions the above printing method is adopted.

SUMMARY

By letting the borders between the image part printed in the previous pass and the image part printed in the successive pass be misaligned from each other between the nozzle rows for the plurality of colors, the streaks are certainly restrained from occurring between the two image parts. For example, if the two image parts deviate in such a direction as to depart from each other, then even in an area without the ink of a certain color landed, the white streak is still prevented from occurring because the ink of another color is landed therein.

However, in order to let the borders between the nozzle rows for the plurality of colors be misaligned according to each ink color, it is necessary to generate as many borders as the number of colors in the overlapping range between the previous pass and the successive pass such that the overlapping range becomes larger. The larger the overlapping range, the less the number of nozzles to be used in each pass, thereby leading to a narrower width of the image part printable in one single pass according to the transport direction. That is, by adopting the above printing method, the image quality may be improved but, because there is an increase in the number of passes necessary for printing on one sheet of the recording medium, the printing time becomes longer. Therefore, there is a problem that the printing time becomes wastefully long even when it is not necessary to adopt the above printing method under ordinary circumstances as when non-uniform shading causes almost no problem such as with a light or low duty or the like.

It is an object of the present teaching to prevent the printing time from becoming wastefully long by carrying out a control to restrain the streak-shaped non-uniform shading from occurring only when necessary such as in the case of conspicuous streaks between the image parts of the previous and successive passes, etc.

According to a first aspect of the present teaching, there is provided an ink jet printer including:

an inkjet head configured to jet ink onto a recording medium while moving in a first direction;

a conveyance section configured to convey the recording medium in a second direction intersecting the first direction, relative to the inkjet head; and a controller configured to control the inkjet head and the transport portion, wherein the ink jet head includes a plurality of nozzle groups each of which includes a plurality of nozzles arrayed along the second direction;

wherein between the plurality of nozzle groups, the nozzles forming the nozzle groups are positioned in conformity with each other, respectively, in the second direction;

wherein the controller causes the conveyance section to convey the recording medium between a first pass and a second pass of the ink jet head such that the respective nozzle groups have partly overlapped scanning areas on the recording medium between the first pass and the successive second pass in the first direction, and causes the ink jet head to print separately between the first pass and the second pass in the second direction in an overlapping range where the scanning areas are overlapped between the first pass and the second pass;

wherein the controller sets usable bordering positions in the overlapping range with respect to the passes, each of the usable bordering position defining a bordering position between the nozzles to be used and the nozzles not to be used in one of the nozzle groups; and wherein the controller sets each of the usable bordering positions for the plurality of nozzle groups based on one of such conditions as a duty of printing on the recording medium and a type of the nozzle groups to be used in printing on the recording medium.

According to the present teaching, the ink jet head includes the plurality of nozzle groups whose nozzles are positioned in conformity with each other according to the second direction. Further, when the ink-jet head prints the image on the recording medium through a plurality of repetitive passes, the image is printed separately between the previous and successive two passes in the overlapping range where the scanning areas of the respective nozzle groups are overlapped partly between the previous and successive two passes. On top of that, each of the usable bordering positions is set individually for the nozzles to be used and the nozzles not to be used in the plurality of nozzle groups according to each pass. By virtue of this, for each pass, it is possible to misalign the usable bordering positions of the nozzles between the plurality of nozzle groups. That is, for each pass, it is possible to deliberately disperse the positions of dots formed respectively at the edge by the plurality of nozzle groups, in the second direction, so as to misalign the same from each other. Therefore, even when there is a relative deviation in the second direction between the image part formed in the previous pass, and the image part formed in the successive pass, any non-uniform shading is still less likely to be in the shape of streaks and thus less likely to be conspicuous, because the shading is dispersed in the joint part between the two image parts.

However, because the usable bordering positions are misaligned between the plurality of nozzle groups, the overlapping range becomes larger between the previous and successive two passes. Due to this, the image part printable through each pass becomes narrower in width according to the second direction. As a result, there is an increase in the number of passes needed to print the image on one sheet of the recording medium. To address this problem, the present teaching is designed to set each of the usable bordering positions of the plurality of nozzle groups according to either the duty of printing the image on the recording medium or the type of the nozzle groups to be used in printing. When the duty is small or light, then the shading is less likely to be conspicuous even when the image parts deviate between the two passes. Further, some types of the nozzle groups (the type of the ink and the like) are less likely to affect the non-uniform shading. According to the present teaching, when it is not necessary to actively suppress the non-uniform shading, then it is possible to prevent the printing time from becoming longer due to an increase in the number of wasteful passes by way of not misaligning the usable bordering positions between the different nozzle groups.

According to a second aspect of the present teaching, there is provided an ink jet printer including:

an ink-jet head configured to jet ink onto a recording medium while moving in a first direction;

a conveyance section configured to convey the recording medium in a second direction intersecting the first direction, relative to the ink-jet head;

a controller configured to control the ink jet head and the conveyance section; and a print setting acquirement section configured to acquire print setting information including a condition related to one of a printing speed and a printing resolution when the ink jet head and the conveyance section are used to carry out printing on the recording medium, wherein the ink jet head includes a plurality of nozzle groups each of which is formed by a plurality of nozzles arrayed along the second direction;

wherein between the plurality of nozzle groups, the nozzles forming the nozzle groups are positioned in conformity with each other, respectively, in the second direction;

wherein the controller causes the conveyance section to convey the recording medium between a first pass and a second pass of the ink jet head such that the respective nozzle groups have partly overlapped scanning areas on the recording medium between the first pass and the successive second pass in the first direction, and causes the ink jet head to print separately between the first pass and the second pass in the second direction in an overlapping range where the scanning areas are overlapped between the first pass and the second pass;

wherein the controller sets usable bordering positions in the overlapping range with respect to the passes, each of the usable bordering position defining a bordering position between the nozzles to be used and the nozzles not to be used in one of the nozzle groups; and wherein the controller sets each of the usable bordering positions for the plurality of nozzle groups based on the print setting information acquired by the print setting acquirement section.

According to the present teaching, each of the usable bordering positions is set for the plurality of nozzle groups according to the print setting information which includes the condition related to at least one of the printing speed and the printing resolution acquired by the print setting acquirement section. By virtue of this, for example, when the printing speed is regarded as important in the print setting, then the printing is carried out through a small number of passes without misaligning the usable bordering positions between the plurality of nozzle groups. On the other hand, when the printing resolution is regarded as important in the print setting, then the usable bordering positions are misaligned between the plurality of nozzle groups, so as to lessen the likelihood for the non-uniform shading to be conspicuous between the two passes.

BRIEF DESCRIPTION OF THE DRAWINGS

FIGS. 7A and 7B depict an example of deviation of image parts formed in two passes, wherein FIG. 7A depicts that the two image parts deviate in departing directions while FIG. 7B depicts that the two image parts deviate in approaching directions;

FIG. 9 depicts the setting of usable bordering positions in a working example 1;

FIG. 10 depicts the setting of usable bordering positions in a working example 2.

DESCRIPTION OF THE EMBODIMENT

Figure 1:
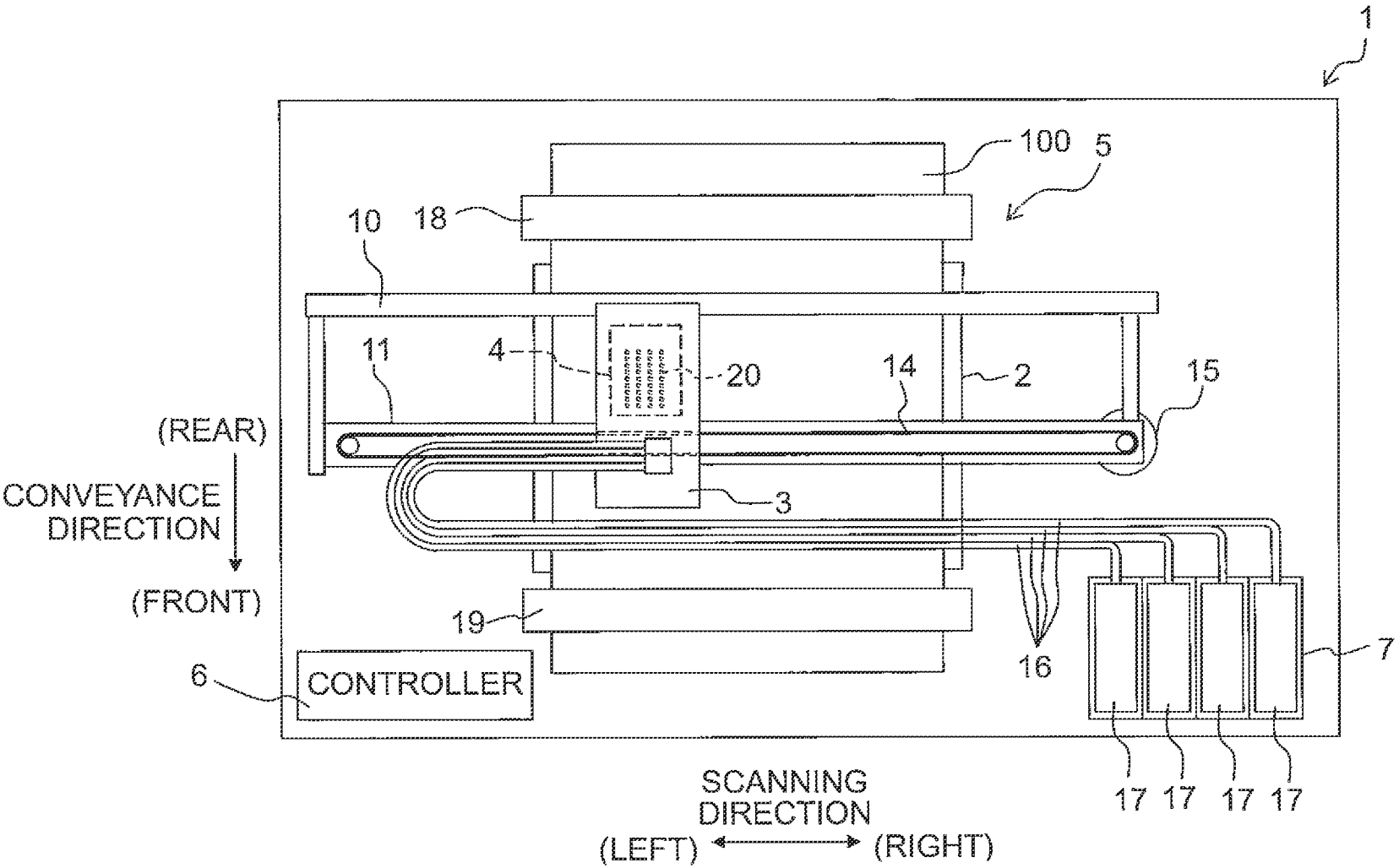
FIG. 1 is a schematic plan view of a printer in accordance with an embodiment of the present teaching.

Next, an embodiment of the present teaching will be explained. The front, rear, left and right directions depicted in FIG. 1 are defined as "front", "rear", "left" and "right" of a printer, respectively. Further, the near side of the page of FIG. 1 is defined as "upper side" or "upside", while the far side of the page is defined as "lower side" or "downside", respectively. The following explanation will be made while appropriately using each directional term of the front, rear, left, right, upside, and downside.

<A Configuration of the Printer>

As depicted in FIG. 1, an ink jet printer 1 includes a platen 2, a carriage 3, an ink jet head 4, a conveyance mechanism 5, a controller 6, etc.

On the upper surface of the platen 2, there is carried a sheet of recording paper 100 which is a recording medium. The carriage 3 is configured to be movable reciprocatingly in a left-right direction (to be also referred to below as a scanning direction) along two guide rails 10 and 11 in a region facing the platen 2. An endless belt 14 is linked to the carriage 3, and a carriage drive motor 15 drives the endless belt 14 whereby the carriage 3 moves in the scanning direction.

The ink-jet head 4 is fitted on the carriage 3 to move in the scanning direction together with the carriage 3. The ink jet head 4 is connected, respectively via tubes 16, with a cartridge holder 7 in which ink cartridges 17 are installed to retain inks of four colors (black, yellow, cyan, and magenta). The ink-jet head 4 has a plurality of nozzles 20 formed in its lower surface (the surface on the far side of the page of FIG. 1).

Figure 3:
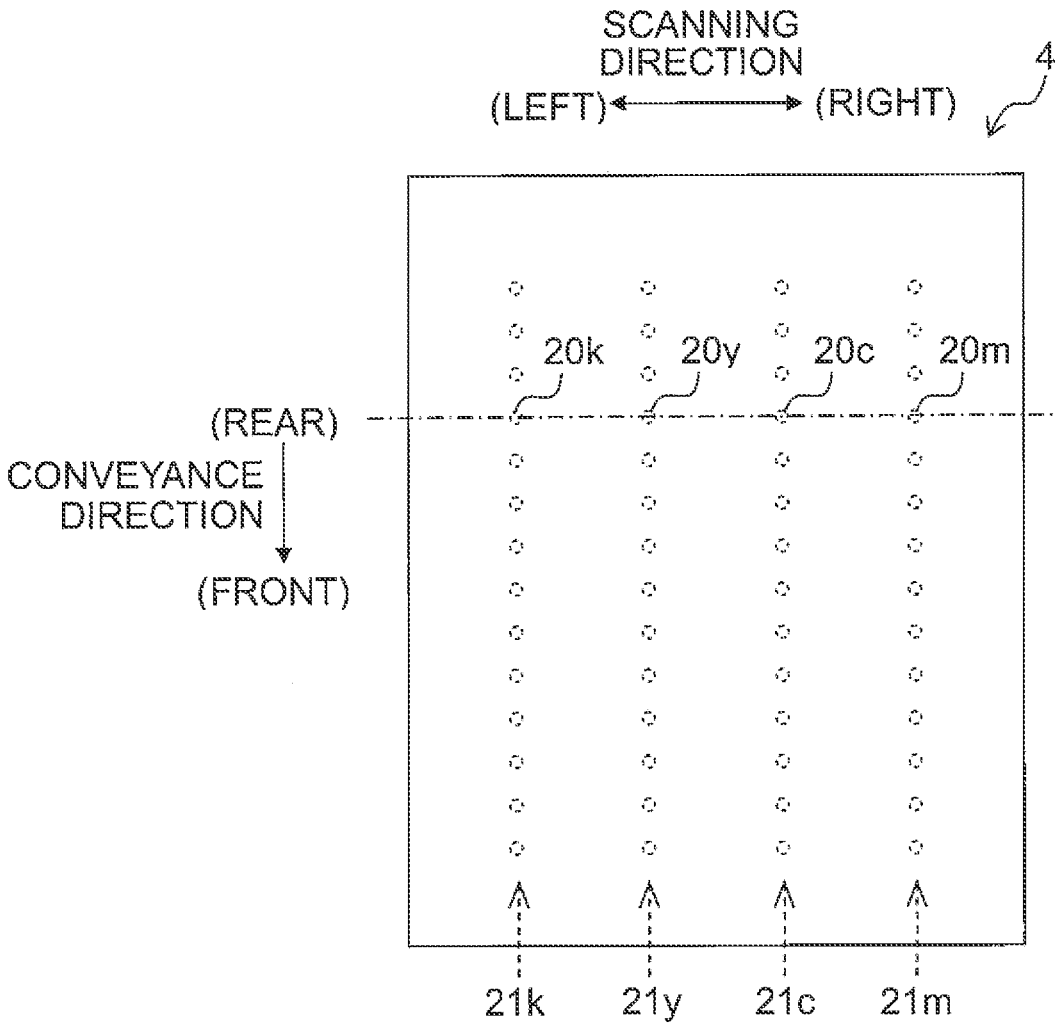
FIG. 3 depicts a nozzle arrayal of an inkjet head.

As depicted in FIG. 3, the plurality of nozzles 20 are arrayed along a transport direction (a front-rear direction) intersecting the scanning direction and, further, form four nozzle rows 21 aligning in the scanning direction. Four nozzle rows 21*k*, 21*y*, 21*c* and 21*m* are the (detailed) nozzle rows 21 configured to respectively jet inks of four colors (black, yellow, cyan and magenta). Further, in the following explanation, the "k", "y", "c" and "m" suffixed to the reference numerals of relevant components depict the configurations corresponding to the inks of black, yellow, cyan and magenta, respectively. For example, the nozzle row 21*k* is formed from the nozzles 20*k* jetting the black ink. Between the four nozzle rows 21*k*, 21*y*, 21*c* and 21*m*, the nozzles 20*k*, 20*y*, 20*c* and 20*m* conform in position with each other in the transport direction to form the respective nozzle rows 21.

As depicted in FIG. 1, the conveyance mechanism 5 has two conveyance rollers 18 and 19 arranged to interpose the platen 2 therebetween in the front-rear direction. The two conveyance rollers 18 and 19 are synchronized and driven by a conveyance motor 22 (see FIG. 2). With the two conveyance rollers 18 and 19 driven by the conveyance motor 22, the conveyance mechanism 5 transports the recording paper 100 carried on the platen 2 in the transport direction.

Figure 2:
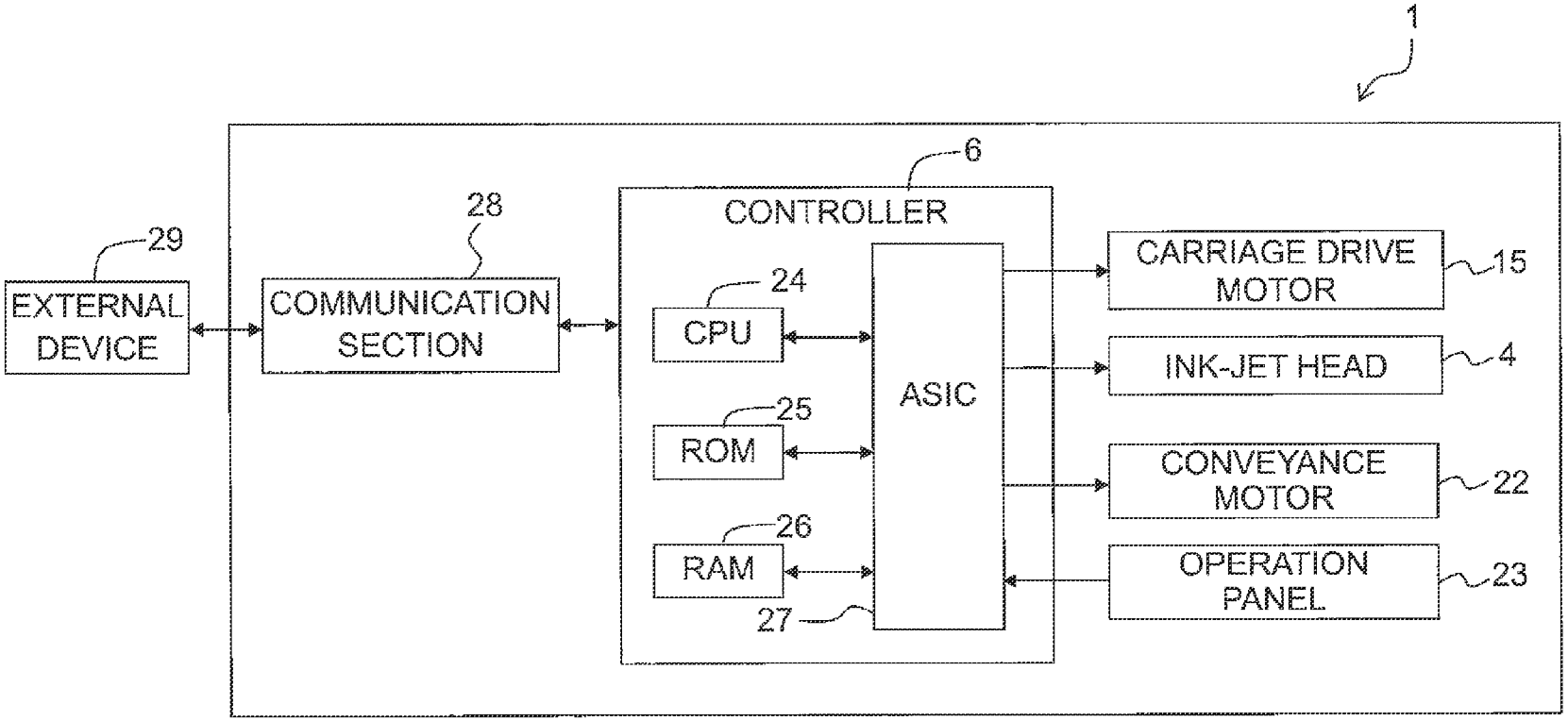
FIG. 2 is a block diagram depicting an electrical configuration of the printer.

As depicted in FIG. 2, the controller 6 is provided with a CPU (Central Processing Unit) 24, a ROM (Read Only Memory) 25, a RAM (Random Access Memory) 26, an ASIC (Application Specific Integrated Circuit) 27 including various types of control circuits, etc. The controller 6 is connected with the ink jet head 4, various types of motors such as the carriage drive motor 15, the conveyance motor 22 and the like, an operation panel 23, etc. Further, the controller 6 is connected with an external device 29 such as a PC or the like via a communication portion 28 such that data of the image to be printed may be input to the controller 6 from the external device 29. Further, various devices other than a PC may serve as the external device 29, including digital cameras, storage devices and the like which are capable of outputting the image data to the printer 1. The controller 6 causes the ASIC 27 to carry out various processes such as printing on the recording paper 100 by letting the CPU 24 execute programs stored in the ROM 25.

Hereinbelow, a detailed explanation will be made on, especially, a process of printing image on the recording paper 100. First, a print command is input to the controller 6 of the printer 1 from the external device 29 such as a PC or the like, or otherwise from the operation panel 23. On this occasion, print setting information including the requirements for printing resolution or printing speed is also input from the external device 29 or the operation panel 23. At the same time, a data of the image to be printed is input from the external device 29 via the communication portion 28. If the print command is input, then the controller 6 controls the inkjet head 4, the carriage drive motor 15 and the like to print the image acquired from the external device 29 on the recording paper 100. In particular, the ASIC 27 of the controller 6 alternately carries out an inkjet operation to jet the inks from the plurality of nozzles 20 while moving the inkjet head 4 together with the carriage 3 in the scanning direction, and a transport operation to let the conveyance rollers 18 and 19 transport the recording paper 100 in the transport direction by a predetermined length.

Further, in this embodiment, when the ink jet head 4 prints the image through a plurality of scans (to be referred to below as passes), the controller 6 carries out a control process to restrain streak-shaped non-uniform shading from occurring between the image part printed in a previous pass and the image part printed in the successive pass. This non-uniform shading restraint printing will be explained below in detail.

<Details of the Non-Uniform Shading Restraint Printing>

Figure 4:
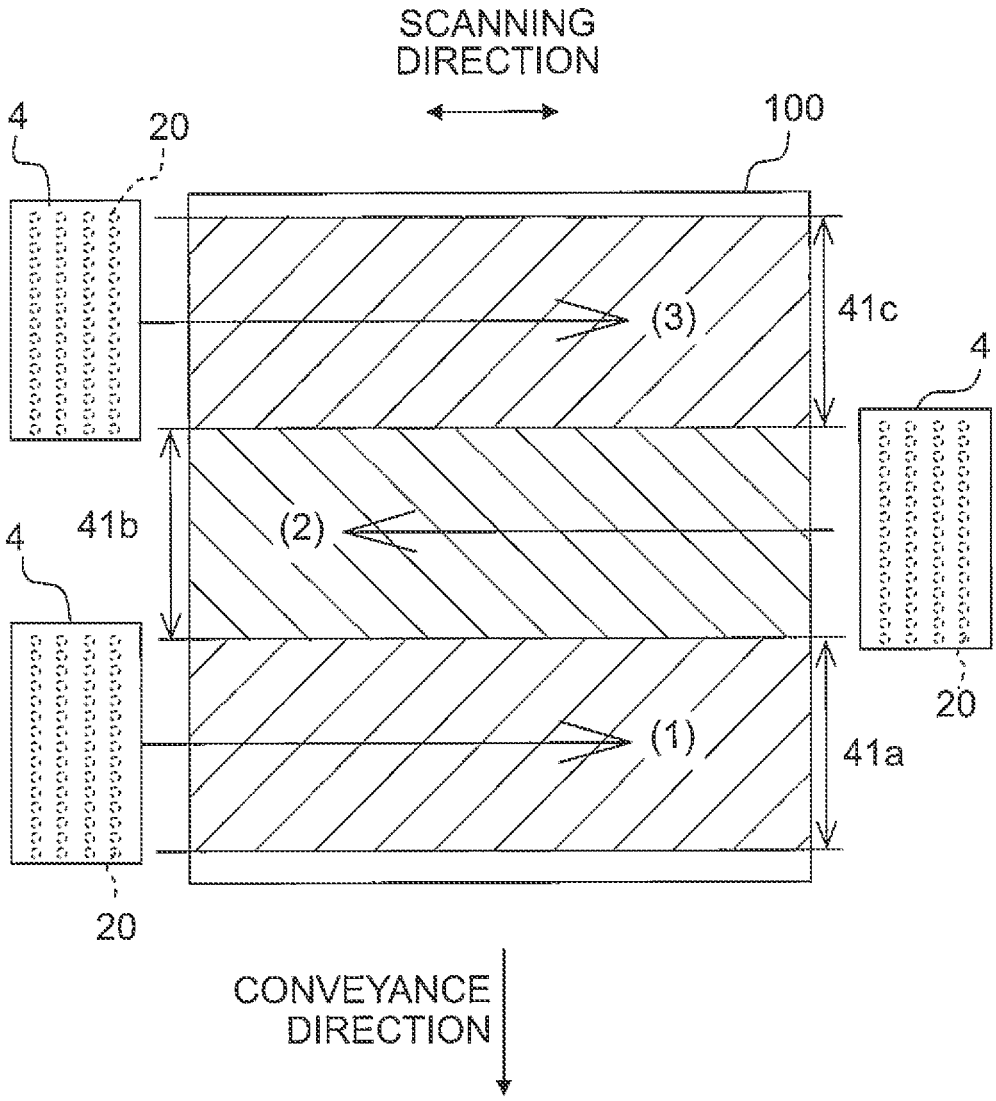
FIG. 4 depicts an image printing without overlapped scanning areas of nozzle rows between passes.

As depicted in FIG. 4, the ink-jet head 4 is printing the image on the recording paper 100 through three passes. That is, the image is printed through such an operation as: jetting the inks in the first pass→conveying the recording paper 100 by a predetermined length→jetting the inks in the second pass→conveying the recording paper 100 by the predetermined length→jetting the inks in the third pass. Further, between the three passes in FIG. 4, scanning areas 41*a*, 41*b* and 41*c* of the nozzle rows 21 do not overlap with each other on the recording paper 100.

On this occasion, the conveyance mechanism 5 may transport the recording paper 100 by the length differing a little between two passes. Alternatively, due to such a factor or the like that the recording paper 100 expands or contracts because of the lending of the inks, the two image parts formed respectively in the two passes may deviate in the transport direction. When the two image parts deviate in directions departing from each other, then an interval is produced between the two image parts such that a white streak appears. Further, when the two image parts deviate in directions approaching each other, then the two image parts have some of the dots thereof overlapping with each other and those parts become darker such that a black streak appears. The white or black streak becomes especially conspicuous when there is a heavy or high print duty, that is, there is a large quantity of the inks being jetted onto the recording paper 100.

Figure 5:
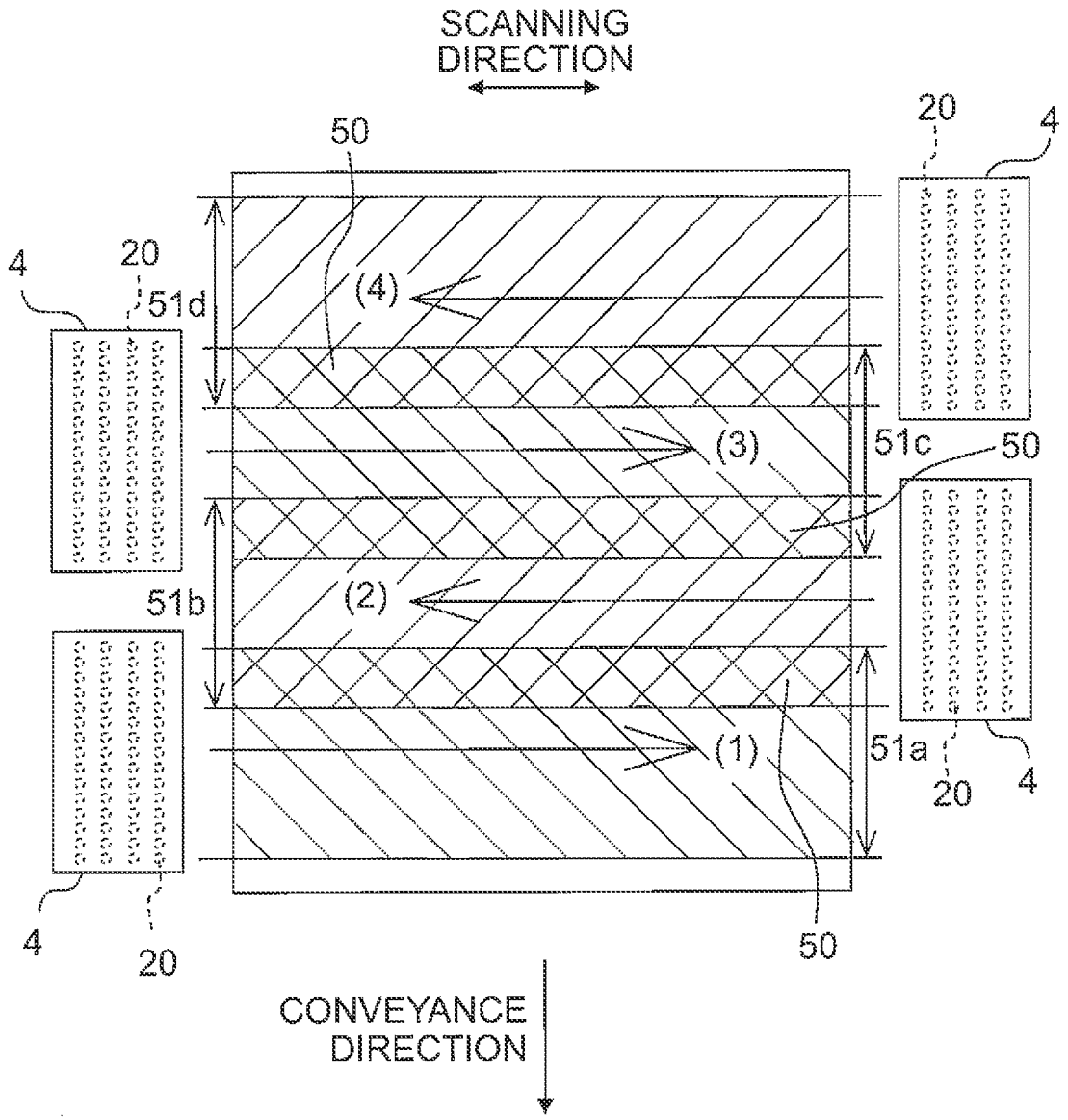
FIG. 5 depicts an image printing with overlapped scanning areas of the nozzle rows between the passes.

In order not to allow any conspicuous white and/or black streaks mentioned above to appear, in the non-uniform shading restraint print of this embodiment, the length of conveying the recording paper 100 between previous and successive two passes is set in such a manner as to partially overlap a scanning area 51 of the nozzle rows 21 in a previous pass with the scanning area 51 of the nozzle rows 21 in the successive pass (see FIG. 5). Further, although the scanning areas 51 of the nozzle rows 21 (the areas through which the nozzle rows 21 move) are overlapped between the passes, it is not the two image parts formed respectively in two passes that are partially overlapped. That is, in overlapping ranges 50 of the overlapped scanning areas 51 of two passes, the image is printed separately in two passes with a certain border therebetween according to the transport direction. That is, in each of the overlapping ranges 50, there is a border between the two image parts formed respectively in two passes. This will be explained below in more detail.

Figure 6:
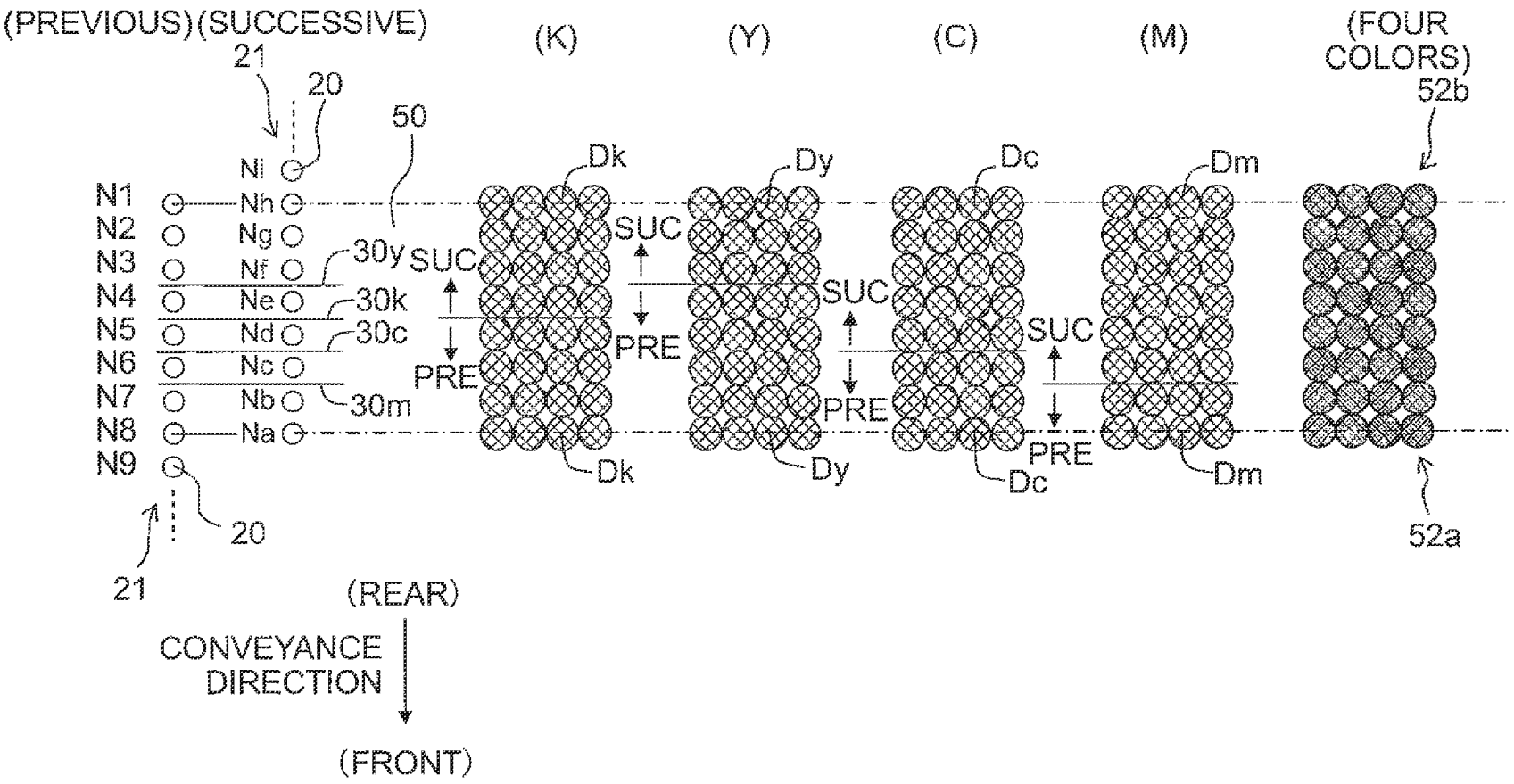
FIG. 6 depicts the usable bordering position of each nozzle row, and an arrangement plan of dots formed respectively in two passes, in the overlapping range of the scanning area between the two passes.

FIG. 6 depicts an arrangement plan of dots D divided respectively into black dots Dk, yellow dots Dy, cyan dots Dc and magenta dots Dm, and a view of the four color dots Dk, Dy, Dc and Dm overlapped with one another.

As depicted in FIG. 6, an overlapping range 50, where the scanning areas 51 of the nozzle rows 21 overlap between two passes, covers eight nozzles (a range of eight dots). When the image is printed in the overlapping range 50, the eight nozzles N1 to N8, which are positioned in a rear end portion of the nozzle rows 21, are used in a previous pass. Further, the eight nozzles Na to Nh, which are positioned in a front end portion of the nozzle rows 21, are used in the successive pass. In FIG. 6, the previous pass is indicated by "PRE", and the successive pass is indicated by "SUC", respectively. On top of that, in each pass, with respect to each of the four color nozzle rows 21, a usable bordering position 30 is set for the nozzles to be used and for the nozzles not to be used, that is, for determining which ones of the eight nozzles 20 to be used. In other words, the "usable bordering position 30" may also be regarded as the bordering position for the nozzles to be used in each pass when the image in the overlapping range 50, where two passes are overlapped, is formed separately in the previous pass and in the successive pass.

For example, when the nozzle row 21 for black is taken as an example, then a usable bordering position 30*k* in the overlapping range 50 is set between the nozzle N4 and the nozzle N5 for the previous pass, but between the nozzle Nd and the nozzle Ne for the successive pass. That is, in the previous pass, the nozzles N5 to N8 are used while the nozzles N1 to N4 on the rear end side are not used. Further, in the successive pass, the nozzles Ne to Nh are used while the nozzles Na to Nd on the front end side are not used.

In this case, when the usable bordering position 30*k* for black aligns with usable bordering positions 30*y*, 30*c* and 30*m* of the nozzle rows 21 for the other three colors, then in the same manner as depicted in FIG. 4, streak-shaped non-uniform shading (white streak; black streak) will arise when deviation occurs in the transport direction between image parts 52*a* and 52*b* printed during the two passes. Therefore, between the nozzle rows 21 for the four colors, the usable bordering positions 30 are misaligned in the overlapping range 50. As depicted in FIG. 6, the usable bordering position 30*y* of the nozzle row 21*y* for yellow is set between the nozzle N3 and the nozzle N4 for the previous pass but between the nozzle Ne and the nozzle Nf for the successive pass. The usable bordering position 30*c* of the nozzle row 21*c* for cyan is set between the nozzle N5 and the nozzle N6 for the previous pass but between the nozzle Nc and the nozzle Nd for the successive pass. The usable bordering position 30*m* of the nozzle row 21*m* for magenta is set between the nozzle N6 and the nozzle N7 for the previous pass but between the nozzle Nb and the nozzle Nc for the successive pass. By virtue of this, in every pass within the overlapping range 50, the four nozzle rows 21 respectively form the dots D at the edge to be deliberately misaligned in position.

Figure 7A:
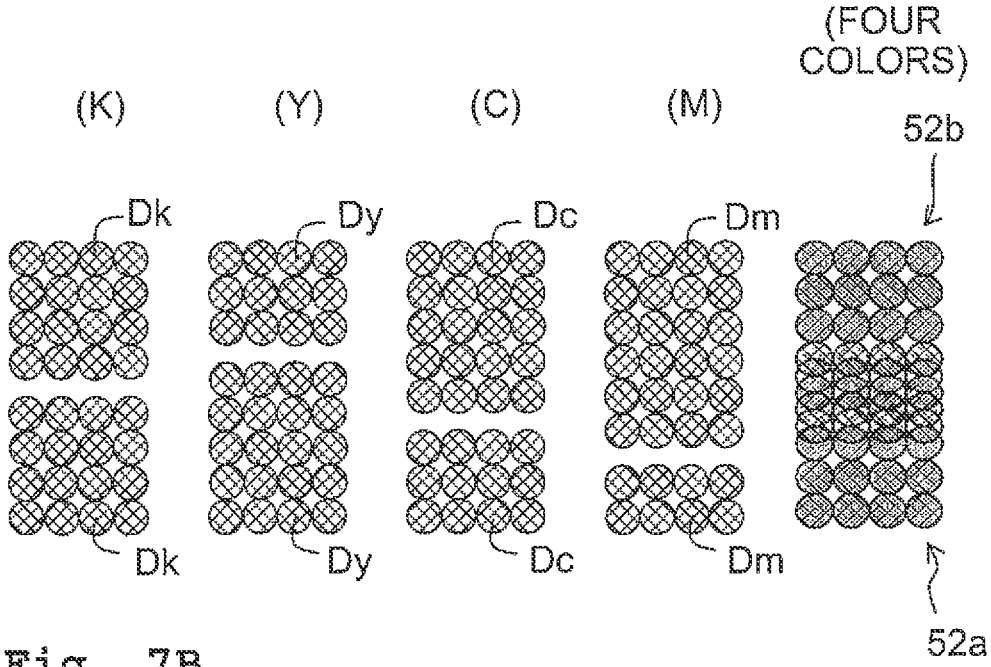
Figure 7B:
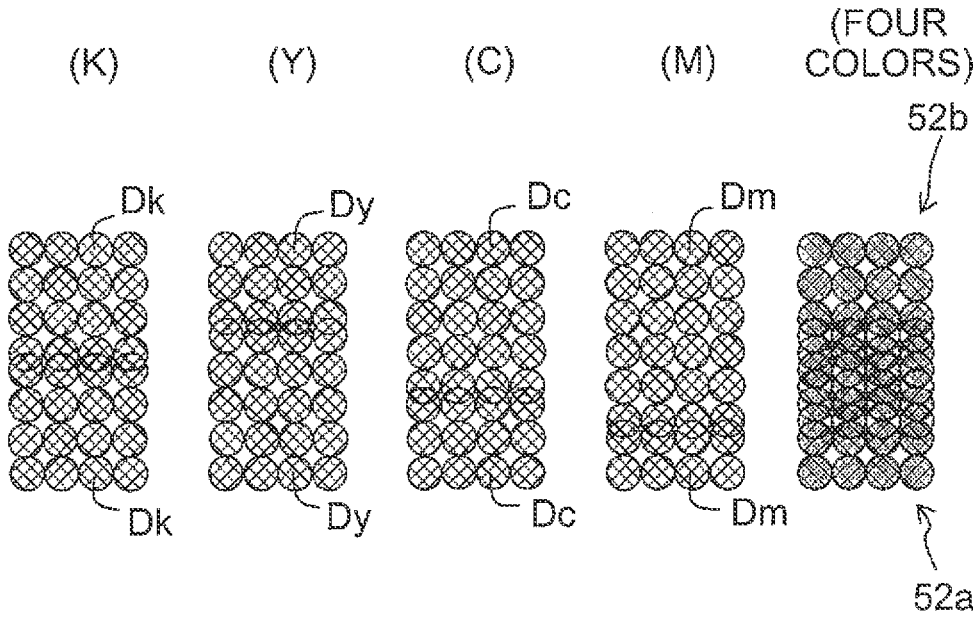

FIG. 7A depicts that the two image parts 52*a* and 52*b* deviate in departing directions. In this case, for the ink of a certain color, even when the dots D formed in the successive pass are separated away from the dots D formed in the previous pass, because the dots D of other colors are arranged to fill the interval, no white streak will arise between the two image parts 52*a* and 52*b* formed respectively in the two passes. On the other hand, FIG. 7B depicts that the two image parts 52*a* and 52*b* deviate in approaching directions. In this case, because the corresponding dots D formed respectively in the two passes are partly overlapped at different positions between the four color inks according to the transport direction, the overlapped positions are dispersed in the transport direction such that the black streaks are less likely to become conspicuous.

However, when the aforementioned non-uniform shading restraint print is carried out, then in order to misalign the usable bordering positions 30 from each other between the four color nozzle rows 21, the overlapping range 50 needs a certain width or more. That is, between a previous pass and the successive pass, because the scanning areas 51 of the respective nozzle rows 21 need to be overlapped with a certain width, the image part 52 printed on the recording paper 100 in one pass becomes smaller and, at that rate, there is inevitably an increase in the number of passes required to print the image on one sheet of the recording paper 100. This fact is easily understood when a comparison is made between FIG. 4 where the non-uniform shading restraint print is not carried out, and FIG. 5 where the non-uniform shading restraint print is carried out. Because it takes a longer time to print if the number of passes is increased, it is preferable not to carry out the aforementioned non-uniform shading restraint print whenever not necessary such as in cases of the non-uniform shading being not so conspicuous. Further, when the non-uniform shading restraint print is carried out, when the usable bordering positions of the four color nozzle rows 21 are set to be more separate, then a greater effect is exerted in suppressing the streak-shaped non-uniform shading. At that rate, however, the printable range in one pass becomes even smaller, thereby increasing the number of passes.

In this embodiment, however, the usable bordering positions of the four color nozzle rows 21 are set in accordance with the (printing) duty or the type of the nozzle rows 21 to be used (the ink color to be used) for printing the image on the recording paper 100. Further, the "duty" in this embodiment includes a total duty Da for all the four color nozzle rows 21, and individual duties Dk, Dy, Dc and Dm for the four color nozzle rows 21*k*, 21*y*, 21*c* and 21*m* respectively.

The total duty Da is the ratio (VNmax) of an actually jetted ink quantity V to the total ink quantity Vmax when all the inks are jetted respectively from all the nozzles 20 able to jet to a predetermined area, in the four nozzle rows 21. Further, if it is possible to change the size of an ink drop jetted from any one of the nozzles 20, then the above Vmax is the total ink quantity when each of the nozzles 20 jets the ink drop at the maximum volume.

On the other hand, an individual duty is the duty for the ink of a single color. If the individual duty Dk for black is taken as an example for the explanation, then it is the ratio (Vk/Vkmax) of the actually jetted black ink quantity Vk to the total ink quantity Vkmax when jetted respectively from all the nozzles 20*k* able to jet to a predetermined area, in the nozzle row 21*k* for black.

The heavier or higher the total duty, the more conspicuous the non-uniform shading between the two image parts 52*a* and 52*b* formed respectively in two passes. Conversely, the lighter or lower the total duty, the less conspicuous the non-uniform shading and hence there is usually no problem without actively suppressing the non-uniform shading. Further, much the same is true on the individual duties: if the individual duty is high with a certain nozzle row 21, then the non-uniform shading is more likely to be conspicuous when that nozzle row 21 is used for printing.

Further, depending on the type of the ink to be used, the non-uniform shading may or may not be more likely to be conspicuous. For example, the streak-shaped non-uniform shading is more likely to be conspicuous if the black ink is used, whereas the non-uniform shading is less likely to be conspicuous when the black ink is not used, that is, if only the other color inks of yellow, cyan and magenta are used. Therefore, by appropriately setting the usable bordering positions of the four color nozzle rows 21 in accordance with the duty and/or the type of the nozzle rows 21 to be used, it is possible to restrain the printing time from extending wastefully.

Figure 8:
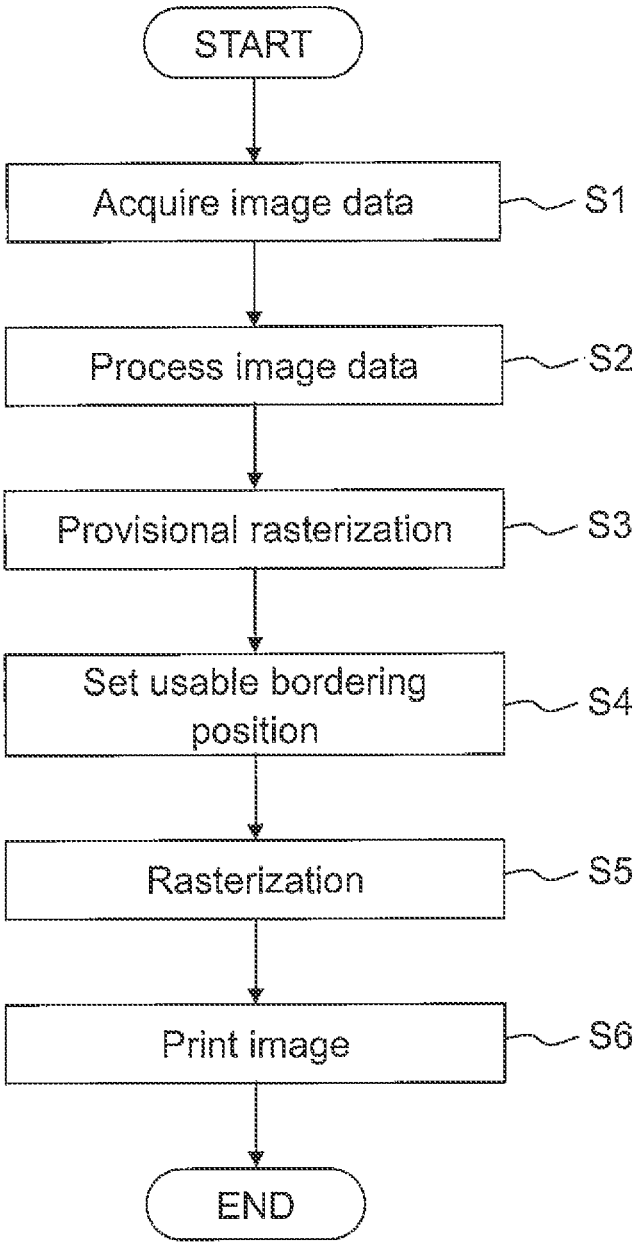
FIG. 8 is a flowchart of a non-uniform shading restraint process.

Si (i=1, 2, 3 . . . ) in FIG. 8 depicts each step of the process. The process flow in the controller 6 is as follows when the non-uniform shading restraint print is carried out. First, when a print command is input from the external device 29 or the operation panel 23, then as depicted in FIG. 8, the controller 6 acquires an image data from the external device 29 via the communication portion 28 (step S1). Next, on the image data, an image data process (step S2) is carried out such as a color conversion process, halftone process, and the like. Further, a provisional rasterization is carried out from the processed data to set the passes for printing the image, and provisionally predetermine through which pass and from which nozzles 20 to jet the ink (step S3). Further, in this stage, the term "provisional rasterization" is used because it has not yet been fixed whether to partly overlap the scanning areas 51 of two passes or, if so, to what extent to overlap the same.

Next, a setting is carried out for the usable bordering position of each nozzle row 21 in the overlapping range 50 where the scanning areas 51 of the two passes overlap (step S4). First, the step determines the ink color(s) to be used (the nozzle rows 21 to be used) and the duties (the total duty and individual duties) in the overlapping range 50 of each pass, based on the data after the provisional rasterization. Then, from the requirements of the colors to be used and the duties, a setting is carried out for the usable bordering positions 30 of the four nozzle rows 21 in the overlapping range 50. For example, it is determined whether to misalign the usable bordering positions 30 from each other between the four nozzle rows 21, whether to cause the same to be aligned at least partially with each other, how long the separated distances to be taken between those positions when aligned with each other, etc. Then, the rasterization is carried out over again based on the setting for the usable bordering positions 30 in the above S4 to fix the settings for the passes in the overlapping range 50 and the like, and in which pass and from which nozzle rows 21 to jet the inks (step S5). Then, the image is printed on the recording paper 100 based on the result of the rasterization of step S5 (step S6).

Next, a few particular examples will be taken below to depict the setting of the usable bordering positions carried out in the above step S4 in FIG. 8 in accordance with the duties and the type of the nozzle rows 21 to be used.

First Exemplified Embodiment

In FIG. 9 and in FIG. 10, the four colors of black (K), yellow (Y), cyan (C) and magenta (M) in the column of "usable bordering position" depict that the usable bordering positions 30 are misaligned when placed in different boxes, whereas the usable bordering positions 30 are aligned when placed in the same box.

In the first exemplified embodiment 1, first, it is determined whether the total duty Da is not less than a predetermined first threshold value (High) or less than the first threshold value (Low). If the total duty Da is High, then regardless of the type of the nozzle rows 21 to be used, the usable bordering positions 30 of the nozzle rows 21 to be used are misaligned from each other. For example, when the four colors of black (K), yellow (Y), cyan (C) and magenta (M) are used, if the total duty Da is High, then the usable bordering positions 30 of the four color nozzle rows 21 are misaligned. Further, likewise, if the nozzle rows 21 to be used are for three colors or for two colors, then the usable bordering positions 30 are misaligned between the nozzle rows 21 for the three or two colors.

On the other hand, when the total duty Da is Low, i.e., less than the predetermined value, then the setting of the usable bordering positions 30 is changed according to the type of the nozzle rows 21 to be used. In particular, when the nozzle row 21*k* for black is used, then the usable bordering positions 30 are misaligned between the nozzle row 21*k* for black and the other nozzle rows 21*y*, 21*c* and 21*m*. However, the usable bordering positions 30 are aligned between the nozzle rows 21*y*, 21*c* and 21*m* for the other colors than black. By aligning the usable bordering positions 30 of the nozzle rows 21 for two colors or more, it is possible to narrow the overlapping range 50 where the scanning areas of the nozzle rows 21 overlap between two passes. Therefore, it is possible to reduce the number of passes needed to carry out printing on one sheet of the recording paper 100.

Second Exemplified Embodiment

FIG. 10 depicts the setting of the usable bordering positions 30 in a working example 2. The working example 2 is the same as the above working example 1 in that the usable bordering positions 30 of the nozzle rows 21 to be used are misaligned from each other when the total duty Da is High. Further, it is also the same as the above working example 1 in that the usable bordering positions 30 are misaligned between the nozzle row 21*k* for black and the other nozzle rows 21*y*, 21*c* and 21*m* when the total duty Da is Low and the nozzle row 21*k* for black is used. However, the second exemplified embodiment is different in that the usable bordering positions 30 are aligned between the nozzle row 21*k* for black, and the nozzle row 21*y* for yellow at low visibility, when the total duty Da is Low and the four color nozzle rows 21 are used.

Third Exemplified Embodiment

In the first and second exemplified embodiments, the usable bordering positions 30 of the respective nozzle rows 21 are set according to the total duty Da. However, the usable bordering positions 30 may otherwise be set by using the individual duty with each of the nozzle rows 21 to be used. Suppose that, for example, the individual duty Dk for black is not less than a predetermined second threshold value, while the individual duties Dy, Dc and Dm for yellow, cyan and magenta are respectively less than the predetermined value. In this case, the usable bordering position 30 of the nozzle row 21 for black with the high individual duty is misaligned from the usable bordering positions 30 between the other nozzle rows 21*y*, 21*c* and 21*m*. In contrast to this, the usable bordering positions 30 of the nozzle rows 21*y*, 21*c* and 21*m* for yellow, cyan and magenta with the low individual duties are aligned with each other.

Fourth Exemplified Embodiment

The third exemplified embodiment may further incorporate a determination of whether the total duty Da is high or low. That is, when the total duty Da is High, then in the same manner as in the above working examples 1 and 2, the usable bordering positions 30 of the nozzle rows 21 to be used are misaligned from each other. On the other hand, when the total duty Da is Low, then the usable bordering positions 30 of the nozzle rows 21 to be used are set according to the higher or lower individual duty than the second threshold value.

Further, in the third and fourth exemplified embodiments, in setting the usable bordering positions 30, only the information of the individual duties is used while the usable bordering positions 30 are not changed according to the type of the nozzle rows 21 to be used. That is, the present teaching does not necessarily need to take the types of the nozzle rows 21 to be used into consideration for setting the usable bordering positions 30.

Fifth Exemplified Embodiment

As in the third and fourth exemplified embodiments, when using the individual duties to determine the usable bordering positions 30, the second threshold value may be compared with values obtained from the individual duties multiplied by a weight coefficient preset for each ink, but not be compared with the individual duties themselves. Further, the above weight coefficient serves to depict how the ink affects the likelihood for the non-uniform shading to be conspicuous. For example, for the black ink, even when the individual duty is low, the black streak is still conspicuous. Hence, the weight coefficient is set to be greater than the other color inks Alternatively, instead of multiplying the individual duties by the weight coefficients, the second threshold value, which is the reference for determining whether the individual duties are high or low, may be caused to differ between the four color nozzle rows 21 according to the likelihood for the non-uniform shading to be conspicuous.

Sixth Exemplified Embodiment

Such values may be obtained by way of multiplying, respectively, every one of the individual duties for the four colors by a weight coefficient preset for each ink. Then, those values may be added together to let their summation be compared with a predetermined third threshold value. The above summation is such a value as can be regarded as such a corrected value of the total duty Da as to have corrected the total duty Da in consideration of the likelihood for the non-uniform shading to be conspicuous. For example, if the summation of those values is not less than the third threshold value, then in the same manner as in the working examples 1 and 2 (FIG. 9 and FIG. 10), the usable bordering positions 30 are misaligned from each other between the four color nozzle rows 21.

Seventh Exemplified Embodiment

In the first to sixth exemplified embodiments, the duties (the total duty or individual duties) are used to set the usable bordering positions 30 of the respective nozzle rows 21. However, without using the duties, the usable bordering positions 30 may be set only with the types of the nozzle rows 21 to be used. For example, when using the nozzle row 21*k* for black, regardless of the duty, the usable bordering position 30*k* of the nozzle row 21*k* for black may be misaligned from the other nozzle rows 21*y*, 21*c* and 21*m*. On the other hand, when only using the nozzle rows 21*y*, 21*c* and 21*m* for the other color inks, regardless of each of the duties, the usable bordering positions 30 of these nozzle rows 21*y*, 21*c* and 21*m* for the other color inks may be aligned with each other.

Eighth Exemplified Embodiment

When the usable bordering positions 30 of two or more of the nozzle rows 21 are misaligned from each other, then the longer the separated distance between those usable bordering positions 30 in the nozzle arrayal direction, the less likely the non-uniform shading to be conspicuous because the shading is dispersed between the two image parts 52*a* and 52*b* formed respectively in two passes. Therefore, according to the duties and/or types of the nozzle rows 21 to be used, it is possible to change the separated distances between the usable bordering positions 30 of the four nozzle rows 21. In FIG. 6 for example, separation is only one-nozzle wide (one-dot wide) between the usable bordering positions 30 of two different nozzle rows 21 (for example, between the usable bordering position 30*k* for black and the usable bordering position 30*y* for yellow). However, when the total duty Da is as high as up to a certain level or above, then the usable bordering positions 30 of two different nozzle rows 21 may be separated two-nozzle wide or more. However, the more separated the usable bordering positions 30 between different nozzle rows 21, the wider the overlapping range 50 by necessity between two passes, thereby increasing the number of passes needed to print on one sheet of the recording paper 100.

Further, when the usable bordering positions 30 of the respective nozzle rows 21 are determined as in the first to eighth exemplified embodiments to be identical for whatever pass, then there are some of the nozzle rows 21 not to be used in any pass. Such nozzles 20 are likely to thicken the inks therein because the inks are not jetted in any way during the printing on the recording paper 100. Therefore, it is preferable to misalign the usable bordering positions 30 of the respective nozzle rows 21 between different passes.

In the embodiment explained above, when printing the image on the recording paper 100 through a plurality of passes of the ink jet head 4, the scanning areas 51 of the nozzle rows 21 are partly overlapped between previous and successive two passes. On top of that, each of the usable bordering positions 30 is set individually for the nozzles to be used or the nozzles not to be used in the four nozzle rows 21 according to each pass. By virtue of this, for each pass, it is possible to misalign the usable bordering positions 30 between the four nozzle rows 21. That is, for each pass, it is possible to deliberately disperse the positions of the four color dots formed respectively at the edge by the four nozzle rows 21, in the transport direction, so as to misalign the same from each other. By virtue of this, even when there is a relative deviation in the transport direction between the image part 52*a* formed in the previous pass, and the image part 52*b* formed in the successive pass, the non-uniform shading is still less likely to be in the shape of streaks and thus less likely to be conspicuous, because the shading is dispersed in the joint part between the two image parts 52*a* and 52*b*.

Further, in this embodiment, the usable bordering positions 30 of the four nozzle rows 21 are set in accordance with either the duties in image printing or the types of the nozzle rows 21 used in printing, respectively. By virtue of this, when it is not necessary to actively suppress the non-uniform shading, then it is possible to prevent the printing time from becoming longer due to a larger number of wasteful passes, by not misaligning the usable bordering positions 30 between the different nozzle rows 21.

In the embodiment explained above, the recording paper 100 corresponds to the "recording medium" of the present teaching. The conveyance mechanism 5 corresponds to the "conveyance section" of the present teaching. The controller 6 corresponds to the "controller" of the present teaching. The nozzle rows 21 correspond to the "nozzle groups" of the present teaching. The communication portion 28 corresponds to the "image data acquirement section" of the present teaching. The left-right direction (the scanning direction) in the embodiment corresponds to the "first direction" of the present teaching while the front-rear direction corresponds to the "second direction" of the present teaching.

Next, a few modifications will be explained which apply various changes to the embodiment described above. However, the same reference numerals (or alphanumerals) are assigned to the components having an identical or similar configuration to those in the abovementioned embodiment, and any explanation therefor will be omitted as appropriate.

Figure 11:
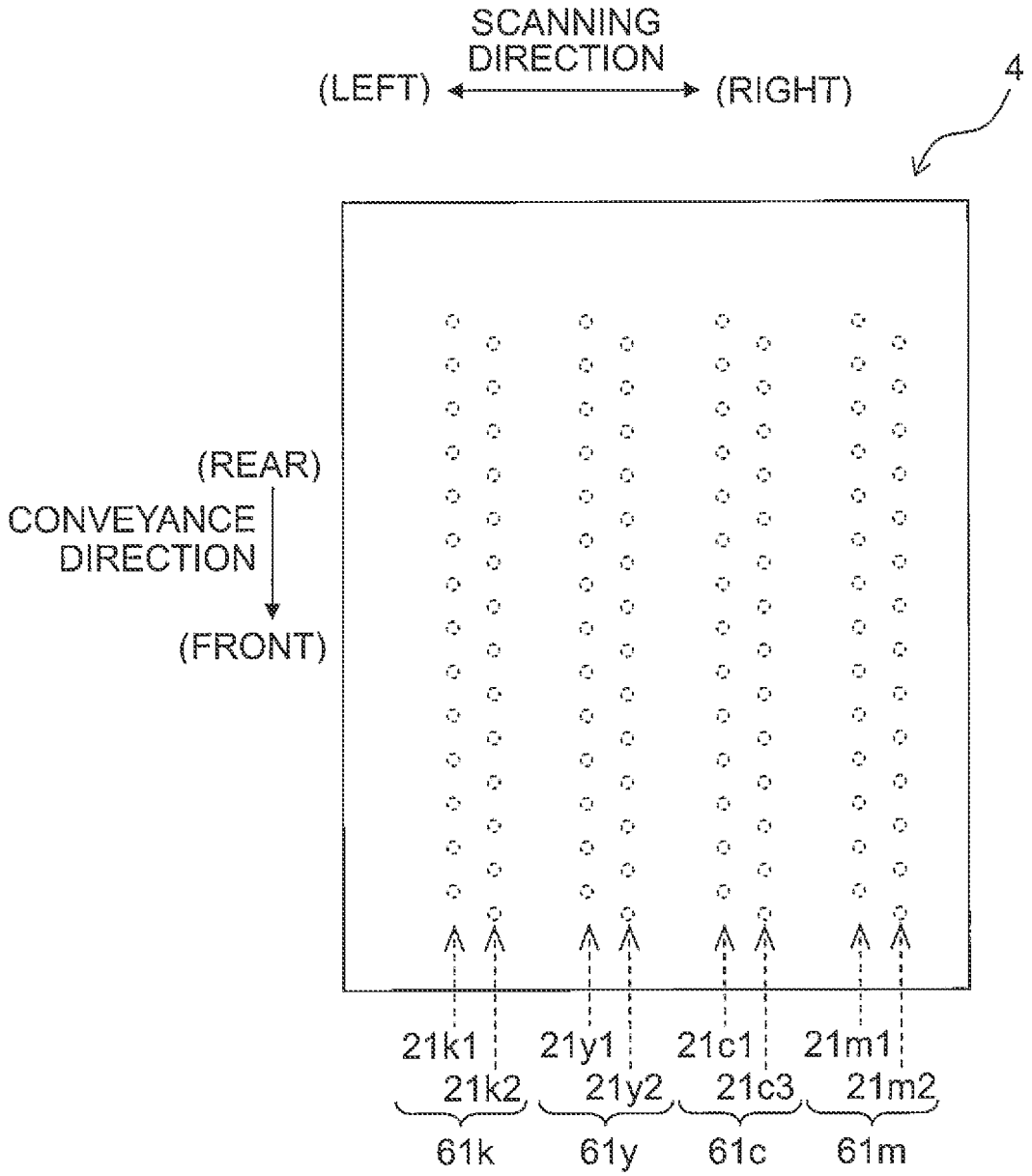
FIG. 11 depicts a nozzle arrayal of an ink-jet head in accordance with a modification.

In the above embodiment, one nozzle row 21 is configured to jet the ink of one color. As depicted in FIG. 11, however, two or more nozzle rows 21 may be configured to jet the ink of one color. In cases of such a configuration, a nozzle group 61 formed from two or more nozzle rows 21 corresponds to the "nozzle group" of the present teaching.

A plurality of nozzle groups of the present teaching, in which the nozzles 20 are aligned in position with each other in the nozzle arrayal direction, are not limited to jetting the inks of the respectively different colors. For example, the plurality of nozzle groups may jet the ink of the same color but be formed respectively from the nozzles 20 different in diameter. In other words, the plurality of nozzle groups may jet ink drops different in size from each other. In this case, the usable bordering positions 30 may be misaligned between the nozzle group of the nozzles 20 of the larger diameter and the other nozzle groups.

The usable bordering position 30 may be set to change itself for each nozzle group during the course of any one pass. In this manner, by misaligning the usable bordering position 30 of each nozzle group from another during the one pass, the non-uniform shading, which arises between two image parts formed respectively in two passes, is further dispersed and thus becomes even less likely to be conspicuous.

In the above embodiment, the usable bordering position 30 is set for each of the plurality of nozzle rows 21 (nozzle groups) in accordance with either the duty or the type of the nozzle rows 21 to be used. In contrast to this, it is possible to set the usable bordering position 30 of each nozzle group in accordance with some print setting information input from the external device 29 such as a PC or the like via the communication portion 28. Further, it is also possible to input the print setting from the operation panel 23 of the printer 1 by way of a user's manipulation. Further, the print setting information may also include a requirement related to at least one of the printing speed and the printing resolution, and be referred to as a print mode.

For example, in a high-speed print mode, the printing speed is regarded as more important than image quality deterioration due to the non-uniform shading arising between the passes. On the other hand, in a high image-quality print mode, even at a little slow printing speed, it is still preferable to restrain the streak-shaped shading from arising by actively carrying out the aforementioned non-uniform shading restraint print. Accordingly, when the print setting for printing speed, printing resolution and the like is input from the external device 29 or the operation panel 23, then the controller 6 sets the usable bordering position 30 for each of the plurality of nozzle groups with respect to each pass, in accordance with that print setting.

By virtue of this, when the printing speed is regarded as more important in the print setting, then the non-uniform shading restraint print is not actively carried out, so as to prevent unnecessary increase in the number of passes. On the other hand, when the printing resolution is regarded as more important in the print setting, then the non-uniform shading restraint print is actively carried out, so as to reliably restrain the streaks and uneven shading from arising between the image parts printed respectively in two passes. Further, in this configuration, either the communication portion 28 acquiring the print setting input from the external device 29 or the operation panel 23 operated by the user corresponds to the print setting acquirement portion of the present teaching.

Conventionally, such a print method is known as to form dots respectively through a plurality of passes different in dot formation pattern, without forming all of the dots in one pass, in the scanning range of the ink jet head on the recording paper. This method is also referred to as multi-pass printing. It is also possible to apply the present teaching to the above multi-pass printing. That is, when the nozzles to be used do not differ in each pass between the nozzle groups for a plurality of colors, then it is conceivable to give rise to non-uniform shading. Therefore, the nozzles to be used (the dot formation pattern) is configured to differ between the nozzle groups for the plurality of colors.

What is claimed is:

1. An inkjet printer comprising:

an inkjet head configured to jet ink onto a recording medium while moving in a first direction;

a conveyance section configured to convey the recording medium in a second direction intersecting the first direction, relative to the inkjet head; and a controller configured to control the inkjet head and the transport portion, wherein the ink jet head includes a plurality of nozzle groups each of which includes a plurality of nozzles arrayed along the second direction;

wherein between the plurality of nozzle groups, the nozzles forming the nozzle groups are positioned in conformity with each other, respectively, in the second direction;

wherein the controller causes the conveyance section to convey the recording medium between a first pass and a second pass of the ink jet head such that the respective nozzle groups have partly overlapped scanning areas on the recording medium between the first pass and the successive second pass in the first direction, and causes the ink jet head to print separately between the first pass and the second pass in the second direction in an overlapping range where the scanning areas are overlapped between the first pass and the second pass;

wherein the controller sets usable bordering positions in the overlapping range with respect to the passes, each of the usable bordering position defining a bordering position between the nozzles to be used and the nozzles not to be used in one of the nozzle groups; and wherein the controller sets each of the usable bordering positions for the plurality of nozzle groups based on one of such conditions as a duty of printing on the recording medium and a type of the nozzle groups to be used in printing on the recording medium.

2. The ink jet printer according to claim 1, wherein the controller sets each of the usable bordering positions for the plurality of nozzle groups based on a total duty with the plurality of nozzle groups in printing on the recording medium.

3. The ink jet printer according to claim 2, wherein the controller misaligns the usable bordering positions from each other between all of the plurality of nozzle groups in a case that the total duty is not less than a predetermined first threshold value, but aligns the usable bordering positions with each other for at least two of the plurality of nozzle groups in a case that the total duty is less than the first threshold value.

4. The ink jet printer according to claim 3, wherein the ink includes a black ink and color inks in two or more different colors; and in a case that the total duty is less than the first threshold value, then the usable bordering positions are misaligned from each other between the nozzle group to jet the black ink and the nozzle groups to jet the color inks, and the usable bordering positions are aligned with each other for at least two of the nozzle groups to jet the color inks.

5. The ink jet printer according to claim 1, wherein the controller sets each of the usable bordering positions for the plurality of nozzle groups based on an individual duty with each of the plurality of nozzle groups in printing on the recording medium.

6. The ink jet printer according to claim 4, wherein the controller misaligns the usable bordering position of a certain one of the nozzle groups from the usable bordering positions of the other nozzle groups in a case that the individual duty with that nozzle group is not less than a predetermined second threshold value.

7. The ink jet printer according to claim 1, further comprising an image data acquirement section configured to acquire a data of an image to be printed, wherein the controller determines, from the data of the image acquired from the image data acquirement section, one of the conditions including the duty and the type of the nozzle group to be used in printing.

8. The ink jet printer according to claim 1, wherein the controller changes the usable bordering position of each of the nozzle groups between the different passes.

9. The ink jet printer according to claim 1, wherein the controller sets the usable bordering positions such that the usable bordering position of each of the nozzle groups change during the course of one of the passes.

10. An inkjet printer comprising:

an inkjet head configured to jet ink onto a recording medium while moving in a first direction;

a conveyance section configured to convey the recording medium in a second direction intersecting the first direction, relative to the inkjet head;

a controller configured to control the ink jet head and the conveyance section; and a print setting acquirement section configured to acquire print setting information including a condition related to one of a printing speed and a printing resolution when the ink jet head and the conveyance section are used to carry out printing on the recording medium, wherein the ink jet head includes a plurality of nozzle groups each of which is formed by a plurality of nozzles arrayed along the second direction;

wherein between the plurality of nozzle groups, the nozzles forming the nozzle groups are positioned in conformity with each other, respectively, in the second direction;

wherein the controller causes the conveyance section to convey the recording medium between a first pass and a second pass of the ink jet head such that the respective nozzle groups have partly overlapped scanning areas on the recording medium between the first pass and the successive second pass in the first direction, and causes the ink jet head to print separately between the first pass and the second pass in the second direction in an overlapping range where the scanning areas are overlapped between the first pass and the second pass;

wherein the controller sets usable bordering positions in the overlapping range with respect to the passes, each of the usable bordering position defining a bordering position between the nozzles to be used and the nozzles not to be used in one of the nozzle groups; and wherein the controller sets each of the usable bordering positions for the plurality of nozzle groups based on the print setting information acquired by the print setting acquirement section.

* * * * *